US010532264B2

(12) United States Patent
Paster

(10) Patent No.: US 10,532,264 B2
(45) Date of Patent: Jan. 14, 2020

(54) GOLF PUTTER ALIGNMENT SYSTEM

(71) Applicant: Jacob H. Paster, Red Bank, NJ (US)

(72) Inventor: Jacob H. Paster, Red Bank, NJ (US)

( * ) Notice: Subject to any disclaimer, the term of this patent is extended or adjusted under 35 U.S.C. 154(b) by 98 days.

(21) Appl. No.: 15/974,096

(22) Filed: May 8, 2018

(65) Prior Publication Data

US 2019/0118060 A1 Apr. 25, 2019

Related U.S. Application Data

(60) Provisional application No. 62/577,004, filed on Oct. 25, 2017.

(51) Int. Cl.

| | |
|---|---|
| ***A63B 69/36*** | (2006.01) |
| ***A63B 53/00*** | (2015.01) |
| *A63B 102/32* | (2015.01) |
| *A63B 53/04* | (2015.01) |

(52) U.S. Cl.

CPC ..... *A63B 69/3685* (2013.01); *A63B 53/007* (2013.01); *A63B 2053/0441* (2013.01); *A63B 2102/32* (2015.10); *A63B 2225/09* (2013.01)

(58) Field of Classification Search

CPC ..... A63B 69/3685; A63B 53/007; A63B 2225/09; A63B 2102/32; A63B 2053/0441

See application file for complete search history.

(56) References Cited

U.S. PATENT DOCUMENTS

| | | | | | |
|---|---|---|---|---|---|
| 1,556,062 | A | * | 10/1925 | Baugh | A63B 69/3685 356/255 |
| 3,019,022 | A | | 1/1962 | Ehmke | |
| 3,043,596 | A | | 7/1962 | Ehmke | |
| 3,273,891 | A | * | 9/1966 | Grim, Jr. | A63B 69/3685 473/240 |
| 3,403,912 | A | * | 10/1968 | Maroun | A63B 69/3685 473/240 |
| 3,727,919 | A | * | 4/1973 | Scott | A63B 69/3685 473/240 |
| 4,367,877 | A | | 1/1983 | Gibson et al. | |
| 4,768,787 | A | | 9/1988 | Shira | |
| 4,925,190 | A | * | 5/1990 | Learned | A01B 1/24 473/286 |

(Continued)

FOREIGN PATENT DOCUMENTS

GB 223044 A * 10/1924 ..... A63B 9/3685

*Primary Examiner* — Stephen L Blau

(74) *Attorney, Agent, or Firm* — Thomas P. O'Connell; O'Connell Law Firm

(57) ABSTRACT

A golf putter alignment system for viewing an orientation of a putter face relative to a putting line. A mirrored viewing surface is retained at a viewing angle by a selective, adjustable mounting system with an engaging portion, a pivot joint for angular adjustment, and a sliding joint for lateral position adjustment. The pivot joint can be a sleeve joint with an outer sleeve pivotable about a longitudinal axis relative to a core member. The sliding joint can be formed with the viewing surface slidable in relation to an elongate member, such as by being retained by a housing that is slidable in relation to the elongate member. A scope surface with an alignment scope can be retained in spaced relation to the viewing surface. In embodiments, the viewing surface can be disposed within the putter head, and a block of transparent material can have a face forming the putter face.

10 Claims, 5 Drawing Sheets

(56) References Cited

U.S. PATENT DOCUMENTS

| | | | | | |
|---|---|---|---|---|---|
| 4,953,866 | A | | 9/1990 | Bang | |
| 4,991,839 | A | * | 2/1991 | Lumbattis, Jr. | A63B 55/10 473/282 |
| 5,071,129 | A | * | 12/1991 | Wilson | A63B 69/3685 473/240 |
| 5,665,011 | A | | 9/1997 | Thomas | |
| 5,730,404 | A | * | 3/1998 | Evans | A63B 55/10 248/156 |
| 5,842,932 | A | * | 12/1998 | Goddard | A63B 69/3685 473/240 |
| 5,846,140 | A | * | 12/1998 | Hoburg | A63B 69/3685 473/240 |
| 5,882,266 | A | * | 3/1999 | Schaum | A63B 69/3614 362/259 |
| 6,190,265 | B1 | * | 2/2001 | Schmitt | A63B 47/02 473/286 |
| 6,743,113 | B2 | * | 6/2004 | Pettinga | A63B 47/02 473/286 |
| 2005/0096144 | A1 | * | 5/2005 | Bullock | A63B 53/007 473/240 |

* cited by examiner

GOLF PUTTER ALIGNMENT SYSTEM

RELATED APPLICATION

This application claims the benefit of U.S. Provisional Patent Application No. 62/577,004, filed Oct. 25, 2017, which is incorporated herein by reference.

FIELD OF THE INVENTION

The present invention relates generally to golf putters. More particularly, disclosed and protected herein is a golf putter with an alignment scope providing multi-point visual alignment of the orientation of the putter face in relation to a target line thereby to enable the golfer to better align putts with a desired target line and, ideally, to sink putts with improved efficiency.

BACKGROUND OF THE INVENTION

The proper and, ideally, the most successful trajectory of a golf ball can be considered to be controlled by three essential factors: the speed at which the club head is traveling at impact, the path along which the club head travels, and the orientation and character of the club face at the site of impact. To establish the proper path and angle of the club head at impact during putting, the golfer must first envision the path along which the ball would be likely to roll from its present position into the cup. Then, under the assumption that the envisioned path of travel is accurate, the golfer must align his or her body and the putter head and shaft relative to the desired initial path of travel of the golf ball. The golfer will then seek to stroke the ball with the putter head disposed perpendicular to the desired initial path of ball travel. In an ideal putt, the putter head will ideally be traveling in perfect alignment with the desired initial path of travel, with the putter head perpendicular to the desired initial path of ball travel, and with the location of impact between the golf ball and the putter face at a predetermined, preferred location.

As anyone who has played golf will attest, establishing the proper alignment of the putter face and the golfer's body and stroking perfectly along the desired path of ball travel are tasks that are difficult in practice. In addition to a plurality of other factors, one fundamental factor that makes proper alignment difficult is that the golfer's line of sight is substantially displaced from the actual point of impact between the putter face and the golf ball. Adding to the difficulties in establishing proper alignment is the fact that a golfer typically determines the preferred path, commonly referred to as 'lining up' the putt, with the golfer's head upright and the golfer's eyes level with one another. However, the actual putting sequence is carried out with the golfer's head tilted over the ball such that the golfer's eyes are not level with one another. With this, the golfer's perceptions of the actual and desired putting lines become skewed.

Still another important factor in relation to the speed and trajectory of a putted ball is the location of the impact between the golf ball and the putter face in relation to a predetermined, preferred location for that impact. For example, many putters are crafted to strike a ball with the most accurate trajectory, speed, and distance when the impact location is in a particular location along the putter face, such as in line with the center of gravity of the putter head or aligned with the effective connection of the putter shaft with the putter head. However, many golfers fail to achieve an alignment between the ball and the ideal impact location in a consistent manner. This reduces the accuracy and consistency of their putts.

Some golfers will tend to "push" putts in a direction outside of the target line. Other golfers may tend to "pull" putts in a direction inside of the target line. Even further, many golfers, aware of their tendency to push or pull will overcorrect thereby producing pulls and pushes.

In light of the foregoing, it is apparent that a golf putter that would improve the golfer's ability to produce a desired alignment between the putter head, the golf ball, and the desired path of ball travel would contribute usefully to the ultimate goal of putting—successfully sinking more putts. Even further, it would be advantageous to provide a putter structure capable of ensuring and promoting putter face impact with a golf ball in alignment with a desired location along the putter head.

SUMMARY OF THE INVENTION

The present invention is founded on the broadly stated object of providing a golf putter alignment system operative to facilitate accurate alignment of the putter head with an intended path of travel of a putted ball thereby to enable the golfer to sink putts with increased efficiency.

A related object of embodiments of the invention is to provide a golf putter alignment system that enables three-point alignment of the putter head, the alignment system, and a golf ball to be putted.

An additional object of embodiments of the invention is to provide a golf putter alignment system wherein a golfer can view the head of the putter and the intended target line simultaneously thereby enabling the golfer to improve the golfer's alignment of his or her body and the putter head.

A further object of embodiments of the invention is to provide a putter construction that demonstrates consistent and accurate performance.

Another object of certain embodiments of the invention is to provide a putter construction that is capable of verifying and promoting impact between a golf ball and the putter face in alignment with a desired location along the putter head.

These and further objects, advantages, and details of the present invention will become obvious not only to one who reviews the present specification and drawings but also to those who have an opportunity to golf with an embodiment of the putter disclosed herein. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth one or more of the foregoing objects, one potential embodiment of the golf putter alignment system provides the golfer with a view of an orientation of a putter face of a putter head of a golf putter relative to a putting line through a mirrored viewing surface for being retained in a plane at a viewing angle in relation to a plane of the putter face and a mounting system for selectively retaining the mirrored viewing surface relative to the golf putter.

The mounting system can in certain practices be an adjustable mounting system that is adjustable to permit an adjustment of the position and orientation of the viewing surface in relation to the plane of the putter face. In such embodiments, the adjustable mounting system can have an engaging portion, such as a clip member, for selectively attaching to the golf putter. The clip member can, for example, be configured to engage a putter shaft of a golf putter in a snap-fit engagement. The adjustable mounting system can further include a pivot joint for permitting adjustment of an angular disposition of the reflective surface relative to the putter face and, additionally or alternatively, a sliding joint for permitting adjustment of a lateral position of the mirrored viewing surface relative to the putter face.

Where a pivot joint is employed to permit adjustment of an angular disposition of the viewing surface relative to the putter face, the pivot joint could, for instance, take the form of a sleeve joint with an outer sleeve pivotable about a longitudinal axis of the outer sleeve in relation to a core member. To permit a pivotable but frictional engagement of the outer sleeve relative to the core member, the core member can have resilient formations therealong. In certain practices of the invention, the outer sleeve can be fixed to pivot with the reflective surface.

Where a joint permits adjustment of a lateral position of the mirrored viewing surface relative to the putter face, it could be a sliding joint. Such a sliding joint could be founded on an elongate member with the mirrored viewing surface being slidable in relation to the elongate member. For example, where the mirrored viewing surface is retained by a housing, the housing can be slidable in relation to the elongate member. The elongate member can have a non-round cross-section, such as by having plural longitudinal ridges that communicate longitudinally along the elongate member.

In embodiments where the mirrored viewing surface is retained by a housing, the housing can have a peripheral wall and a lower wall. The peripheral wall and the lower wall cooperate to define an inner volume. Such a housing can have an open top and an open anterior portion, and the mirrored viewing surface can be disposed on the lower wall of the housing. Furthermore, a scope surface can be retained in spaced relation to the mirrored viewing surface. The scope surface can be transparent, and an alignment scope, such as a crosshair alignment scope, can be disposed on the scope surface.

In other embodiments, a golf putter alignment system for providing a golfer with a view of an orientation of a putter face of a putter head of a golf putter relative to a putting line can be provided with a putter head with a putter face and a putter shaft fixed to the putter head. A mirrored viewing surface is retained in a plane at a viewing angle in relation to a plane of the putter face with the mirrored viewing surface being disposed within the putter head. Moreover, a block of transparent material can have a first face comprising at least a portion of the putter face.

In such embodiments, the block of transparent material can further have a second face comprising a scope surface, and an alignment scope can be disposed on the scope surface. For example, the block of transparent material can have a substantially triangular perpendicular to the putter face with the putter face being formed by a first leg of the triangle, the scope surface being formed by a second leg of the triangle, and the hypotenuse of the triangle being disposed in juxtaposition with the mirrored viewing surface. Still further, one or more sight lines can be disposed on the mirrored viewing surface. In very particular embodiments, the block of transparent material can comprise a block of a single crystal of laboratory-grown sapphire ($Al_2O_3$).

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

The golf putter alignment system disclosed herein is subject to a variety of embodiments, each within the scope of the invention. However, to ensure that one skilled in the art will be able to understand and, in appropriate cases, practice the present invention, certain preferred embodiments of the broader invention revealed herein are described below and shown in the accompanying drawing figures.

Figure 1:
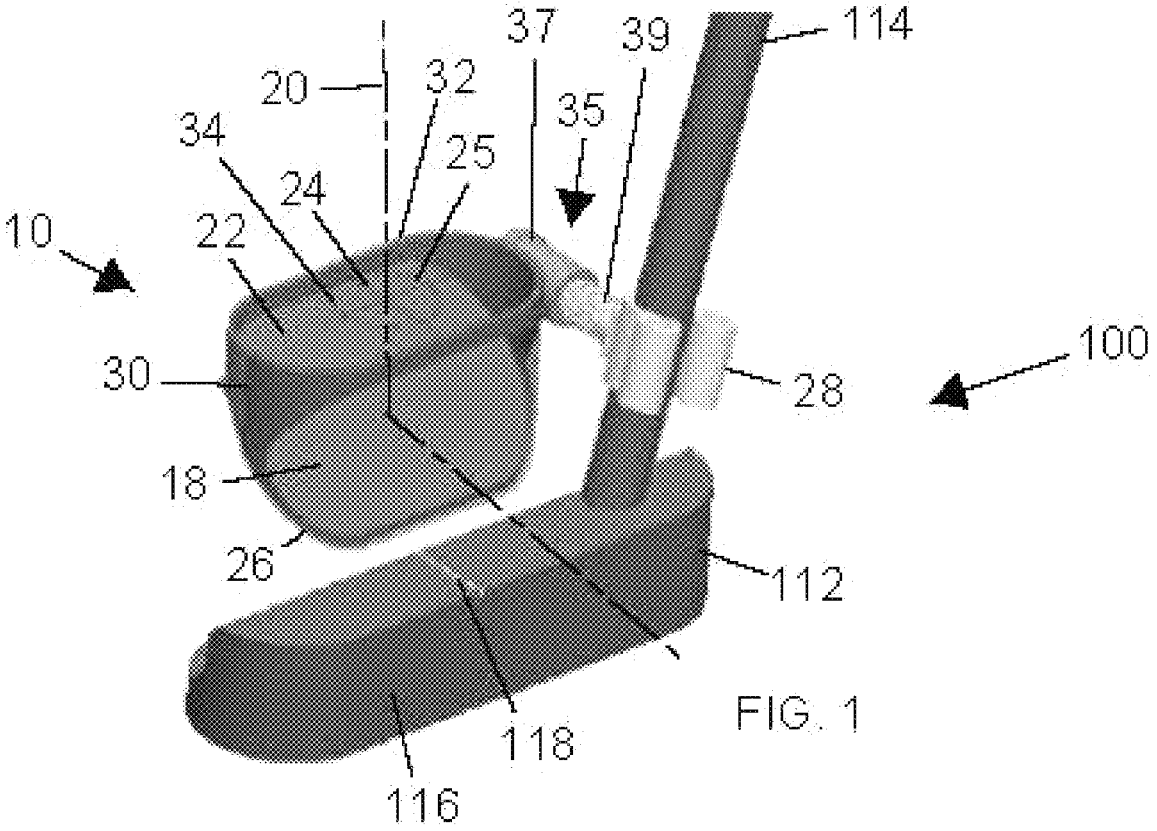
FIG. 1 is a perspective view of an alignment system as disclosed herein mounted to a golf club putter.

Looking more particularly to the drawings, an embodiment of the golf putter alignment system is indicated generally at 10 in FIG. 1. There, the alignment system 10 is shown mounted to a golf putter 100, the golf putter 100 having a putter head 112 retained by a putter shaft 114. The putter head 112 has a putter face 116 for striking putts. A sight line 118 is centrally disposed on the putter head 112 with an orientation perpendicular to the plane of the putter face 116.

The putter face 116 presents a substantially planar ball striking surface disposed in a plane of orientation. The plane of orientation has a vertical alignment angle measured by the orientation of the plane with respect to vertical and a horizontal alignment angle measured by the orientation of the plane with respect to a desired target line of a golf ball on initial impact with the putter face 116.

The vertical alignment angle of the putter face 116, which may alternatively be referred to as the loft of the putter face 116, at and through impact determine the launch angle and spin of the golf ball. The effective loft applied to the putted ball will be the result of the static loft of the putter face 116 and the shaft lean at impact. The desired vertical alignment angle or launch angle of the putter face 116 at impact may vary depending on the golfer, the design of the putter 100, the actual putting situation, and other factors. For instance, a flat launch angle and initial top spin of the putted ball might be preferred by certain golfers on fast greens so that a delofting of the putter face 116 may be sought while another situation, such as on a slow or soft green, may warrant a vertical alignment angle at or even above the static loft of the putter face 116.

While the desired vertical alignment angle of the putter face 116 may vary from golfer to golfer and putting situation to situation, it is nearly universally true that the putter face must be perpendicular to the desired target line at impact for a putt to be struck true to that target line and to have the best opportunity to be made. To that end, most putters 100, like the example depicted, have one or more sight lines 118 or other alignment mechanisms designed to assist the golfer in aligning the putter face 116 perpendicularly to the desired target line at impact. However, as discussed hereinabove, the ability to align putts using such standard sight lines 118 and the overall perception of the orientation of the putter 100 suffers from a number of shortcomings, including the skewing effect deriving from the tilting of the golfer's head and other factors.

The golf putter alignment system 10 disclosed herein enables the establishment of the desired vertical and horizontal alignment angles at setup and the confirmation of the same through impact with the goal of improving putting accuracy and permitting a holing of putts with greater efficiency. Pursuant to the depicted embodiment of the invention, a mirrored viewing surface 18 is selectively and adjustably retained relative to the putter 100 for providing a line of sight 20 from the golfer's eyes while standing over the putter 100 and the putt that is reflected along a target line. As taught herein, the location and orientation of the mirrored viewing surface 18 in relation to the putter 100 can be adjusted, including to move the mirrored viewing surface 18 longitudinally in relation to the putter shaft 114 and to adjust the angular disposition of the mirrored viewing surface 18 in relation to the putter 100 and thus the golfer's line of sight 20 about vertical and horizontal axes of rotation. The path and orientation of the line of sight 20 can thus be readily adjusted to facilitate accurate setup of the golfer and the putter 100 in relation to an intended target line and to provide accurate feedback with respect to putter orientation and movement at and through impact with a golf ball.

In the embodiment of the putter alignment system 10 of FIGS. 1 through 5, the viewing surface 18 is retained by a housing 30. The mirrored viewing surface 18 can be of any type capable of providing a reflection to permit a reflected line of sight 20. Accordingly, the viewing surface 18 could be formed by a mirror, a highly polished surface, or some other structure capable of providing a reflection. The housing 30 has a peripheral wall 32 and a lower wall 26 that together define an inner volume of the housing 30. The housing 30 has an open top and an open front. The open top of the housing 30 is bounded by the peripheral wall 32, and the open front has an upper boundary formed by a lower edge of the peripheral wall 32 and a lower boundary formed by a leading edge of the lower wall 26. The upper edge of the peripheral wall 32 resides in a plane. In certain embodiments, the viewing surface 18 could be formed from a polishing or other treatment of the surface of the lower wall 26 to provide a reflection.

The lower wall 26 in this embodiment is formed as a panel of material. The lower wall 26 could alternatively be a surface of a block or other structure. The lower wall 26 is disposed at a viewing angle, such as approximately forty-five degrees (45°), in relation to the peripheral wall 32 and the plane in which the upper edge of the peripheral wall 32, the edge of the peripheral wall distal to the lower wall 26, resides.

A scope surface 22 is retained in a plane parallel to, potentially substantially coplanar with, the upper edge of the peripheral wall 32. The lower wall 26 is thus disposed at the viewing angle relative to the scope surface 22. The scope surface 22 is translucent, preferably transparent. The scope surface 22 could be formed from a panel of transparent material, or the scope surface 22 could be the surface of a block of transparent material. Such a block of transparent material forming the scope surface 22 could, for example, occupy all or substantially all of the inner volume of the housing 30.

A crosshair alignment scope 25 is applied to the transparent or translucent scope surface 22. The crosshair scope 25 could be applied in any manner. By way of non-limiting examples, the crosshair scope 25 could be applied by printing, by etching, frosting, scoring, by decal application, or by any other method or combination thereof. The crosshair scope 25 has a circular portion 34 and orthogonally disposed crosshairs 24 that meet at the center of the circular portion 34 with one crosshair 24 aligned with a plane perpendicular to the surface of the lower wall 26 and a second crosshair 24 aligned with a plane parallel to the surface of the lower wall 26. The crosshair scope 25 is laterally centered on the scope surface 22 and in relation to the housing 30.

The housing 30 and the mirrored viewing surface 18 retained thereby are selectively and adjustably affixed to the shaft 114 of the putter 100 by a mounting system. The mounting system has an engaging portion for selectively attaching to the shaft 114, a pivot joint 35 for permitting adjustment of the angular orientation of the housing 30 and the viewing surface 18 relative to the shaft 114, the putter head 112, and the putter 100 in general, and a sliding joint 36 for permitting adjustment of the lateral position of the housing 30 and the viewing surface 18 relative to the shaft 114, the putter head 112, and the putter 100 in general.

The engaging portion is in this embodiment formed by a clip member 28. The clip member 28 is configured to engage the shaft 114 securely to retain the alignment system 10 in place relative to the putter 100. In the depicted embodiment, the clip member 28 engages the shaft 114 in a snap-fit engagement. All or a portion of the clip member 28 could be of high-friction material or coated with a high-friction material, such as a rubberized coating, to resist displacement in relation to the shaft 14 and the golf club 10 in general. A clamping or other securing mechanism, such as a setscrew or any other securing mechanism, can be incorporated for fixing the clip member 28 and, derivatively, the alignment system 10 in place.

Figure 2:
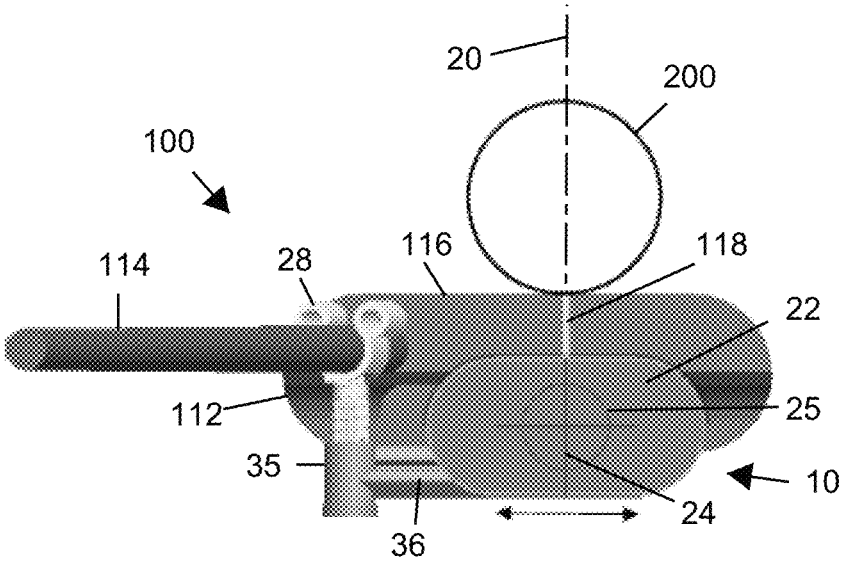
FIG. 2 is a top plan view of the alignment system of FIG. 1, again mounted to a golf putter.
Figure 3:
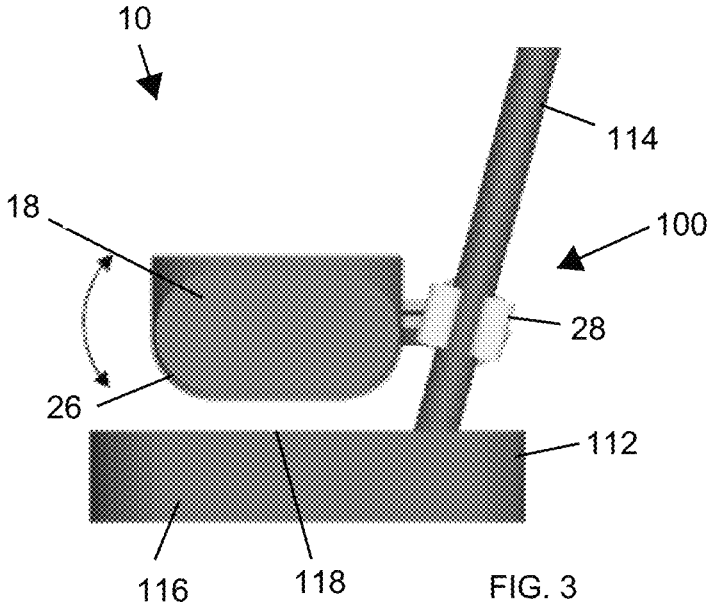
FIG. 3 is a view in front elevation of the alignment system of FIG. 1 mounted to a golf putter.
Figure 4:
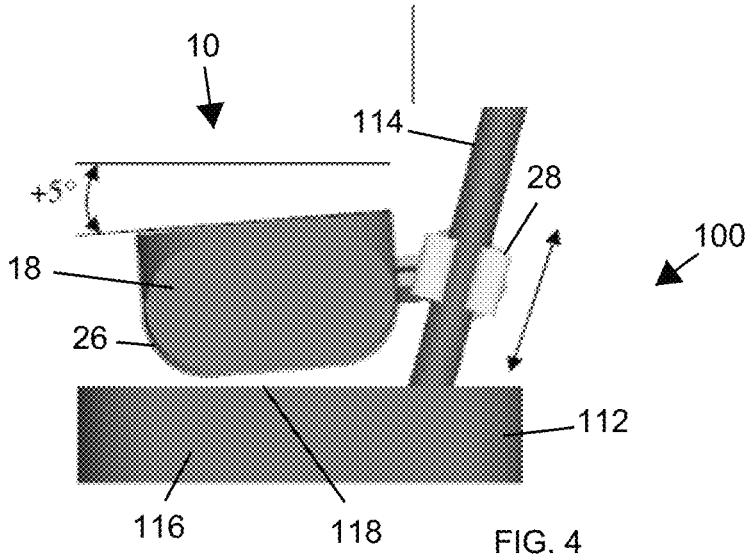
FIG. 4 is a view in front elevation of the alignment system of FIG. 1 mounted to a golf putter in an adjusted disposition.
Figure 5:
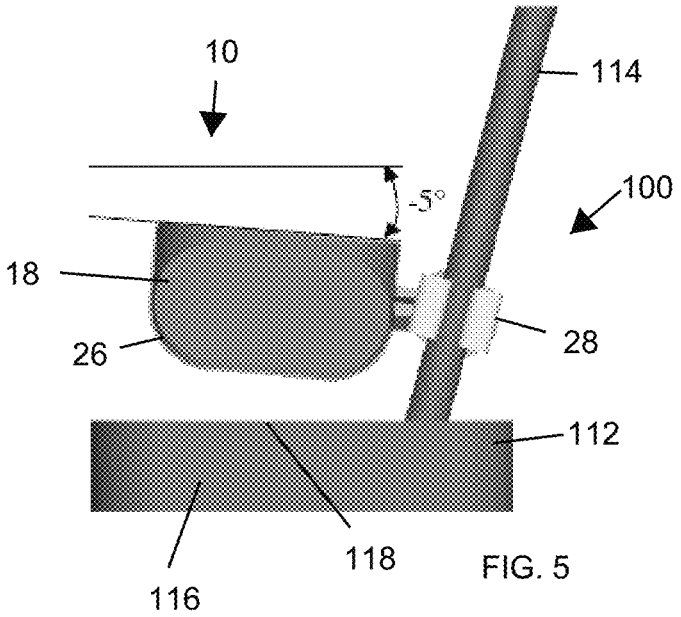
FIG. 5 is a view in front elevation of the alignment system of FIG. 1 mounted to a golf putter in an alternatively adjusted disposition.

The pivot joint 35, which can be best understood with reference to FIG. 2, establishes a pivotable connection between the housing 30 and the engaging portion and thus in relation to the putter 100 to permit adjustment of the angular orientation of the housing 30 and the viewing surface 18 relative to the shaft 114. In this embodiment, the pivot joint 35 comprises a sleeve joint wherein an outer sleeve 37 is pivotable about a longitudinal axis thereof relative to a core member 39. In this embodiment, the outer sleeve 37 and the core member 39 are frictionally engaged. The core member 39 depicted has resilient formations therealong to permit the pivotable but frictional engagement of the outer sleeve 37 relative to the core member 39.

With continued reference to FIG. 2, the sliding joint 36 permits the housing 30 and the viewing surface 18 to be adjusted laterally relative to the shaft 114, the putter head 112, and the putter 100 in general. In the depicted embodiment, the sliding joint 36 is formed by an elongate member, also indicated at 36, with the housing 30 slidable therealong. The elongate member 36 has a non-round cross-section thereby to maintain the housing 30 and the viewing surface 18 in a given orientation relative thereto. In this case, the non-round cross-section comprises having the elongate member 36 formed with four longitudinal ridges that travel longitudinally along the elongate member 36 in what essentially forms a plus sign shaped cross-section. The housing 30 and the viewing surface 18 retained thereby can thus be slid laterally in relation to the putter head 112, the shaft 114, and the putter 100 in general by sliding along the elongate member 36.

Under this construction, a golfer using the alignment system 10 can be provided with a true line of sight 20 with multi-point visual alignment of the orientation of the putter face 116 in relation to a target line and a golf ball 200 thereby to enable the golfer to better align and strike putts along the desired target line. As can be perceived, for instance, by further reference to FIG. 2, a golfer looking directly down onto the golf putter head 112 and the alignment system 10 will readily be able to perceive and confirm the multi-point alignment of the crosshair scope 25, including the orthogonally-disposed crosshairs 24, the putter head 112, including with the sight line or lines 118 thereof, the golf ball 200, and the actual orientation of the putter head 112 in relation to the desired target line from the remote vantage point provided by the viewing surface 18. As may be desirable or necessary, the orientation and lateral position of the alignment system 10 in relation to the putter head 112 and the putter 100 in general can be readily adjusted. For instance, the lateral position of the alignment system 10 can be adjusted by use of the sliding joint 36 to ensure lateral alignment of the crosshair scope 25 in relation to the sight line or lines 118 of the putter head 112. Further, as is suggested by FIGS. 4 and 5, for instance, the line of sight 20 provided by the mirrored viewing surface 18 of the alignment system 10 can selectively be adjusted by adjusting the angle of the alignment system 10 and the viewing surface 18 by use of the pivot joint 35, such as to adjust the viewing surface 18 to a neutral position as in FIG. 3, to a negatively canted disposition as in FIG. 4, or to a positively canted position as in FIG. 5.

While the viewing surface 18 is in this example fixed in relation to the housing 30, the disposition of the viewing surface 18 can be readily adjusted by adjusting the disposition of the housing 30 by use of the engaging portion, the pivot joint 35, and the sliding joint 36. It will be understood that, while the viewing surface 18 is fixed in relation to the housing 30 in the depicted embodiment, manifestations of the invention with a viewing surface 18 adjustable in relation to the housing 30 are possible and within the scope of the invention except as may be expressly excluded by the claims.

Figure 6:
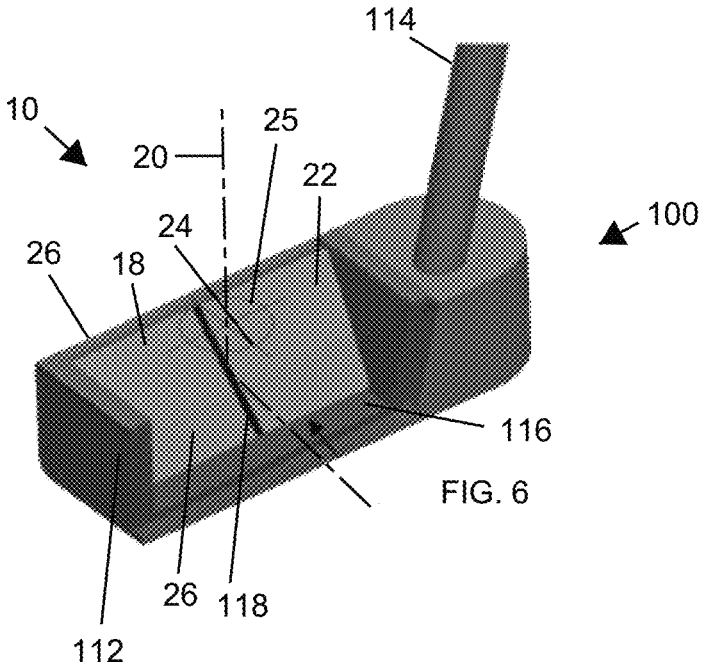
FIG. 6 is a perspective view of an alternative embodiment of the invention wherein the alignment system is directly incorporated into a golf putter.
Figure 7:
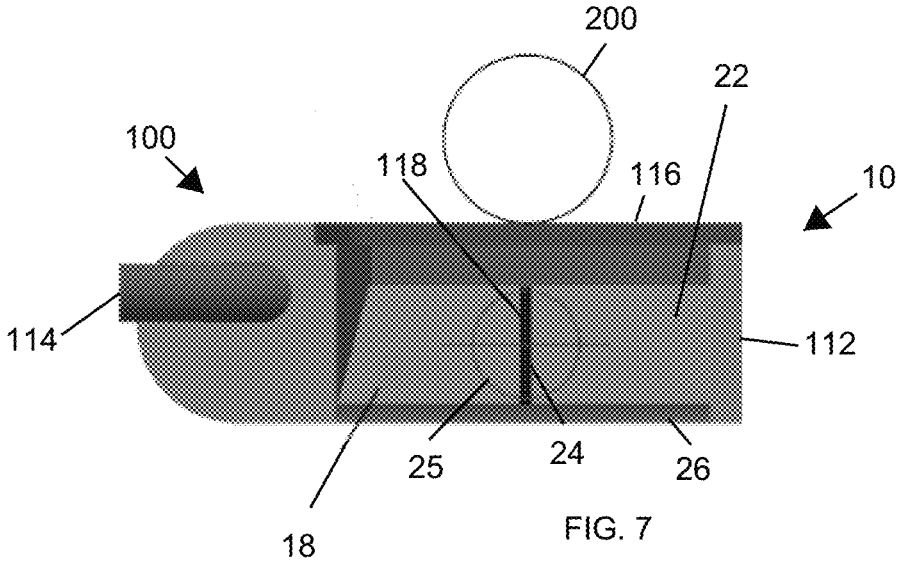
FIG. 7 is a top plan view of the golf club putter with an alignment system of FIG. 6.
Figure 8:
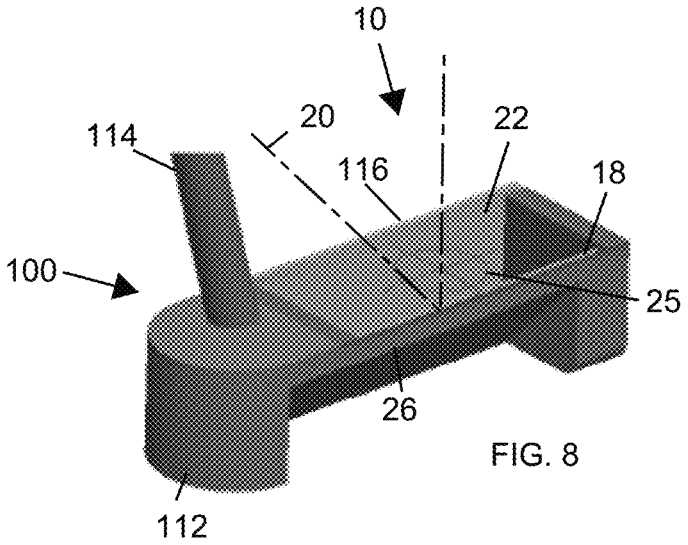
FIG. 8 is a rearward perspective view of the golf club putter with an alignment system of FIG. 6.

An alternative embodiment of the alignment system is again indicated generally at 10 in FIGS. 6 through 8. There, the alignment system 10 again has a mirrored viewing surface 18 retained at an angle in relation to a putter head 112 of a putter 100. Here, however, the viewing surface 18 and the alignment system 10 in general are integrated into the putter head 112. The lower wall 26 relative to which the reflective surface 18 is retained can comprise a surface of a panel of material or of a posterior block of material. The lower wall 26 and the viewing surface 18 are aligned in lateral orientation with the putter face 116 and are maintained at a given vertical viewing angle, such as forty-five degrees, relative to the vertical orientation of the putter 100 such that the line of sight 20 of the golfer looking into the viewing surface 18 from a position directly above the putter head 112 will be reflected by the viewing surface 18 to travel along a path orthogonal to the actual orientation of the putter face 116. It will again be noted that the angle at which the viewing surface 18 is disposed may vary to accommodate, for example, different users and putter designs. With this, the golfer can be precisely apprised of the orientation of the putter face 116 relative to a desired path of travel of a struck golf ball 200.

A scope surface 22 is retained in a plane perpendicular to the plane of the putter face 116. Accordingly, a plane of the scope surface 22 is disposed at the viewing angle, such as forty-five degrees, relative to the reflective surface 18. The scope surface 22 is translucent, preferably transparent. The scope surface 22 could be formed on a panel of transparent material, or the scope surface 22 could be the surface of a block of transparent material. In this example, the scope surface 22 comprises the upper surface of a solid block of transparent material with a right triangular lateral cross-section with a first leg of the triangle forming the putter face 116, a second leg of the triangle forming the scope surface 22, and the hypotenuse of the triangle disposed in juxtaposition with the reflective surface 18.

A crosshair alignment scope 25 is applied to the transparent or translucent scope surface 22. The crosshair scope 25 could be applied in any manner. By way of non-limiting examples, the crosshair scope 25 could be applied by printing, by etching, frosting, scoring, by decal application, or by any other method or combination thereof. The crosshair scope 25 has a circular portion and orthogonally disposed crosshairs 24 that meet at the center of the circular portion 34 with one crosshair 24 aligned with a plane perpendicular to the surface of the lower wall 26 and a second crosshair 24 aligned with a plane parallel to the surface of the lower wall 26. The crosshair scope 25 is laterally centered on the scope surface 22 and in relation to the putter face 116. A further sight line 118 is disposed on the viewing surface 18 traveling in a plane perpendicular to the plane of the putter face 116.

In certain embodiments of the alignment system 10, the scope surface 22 comprises the upper surface of a solid block of a single crystal of material, such as a single crystal Sapphire. The single crystal of material has a right triangular lateral cross section with a first leg of the triangle forming the putter face 116, a second leg of the triangle forming the scope surface 22, and the hypotenuse of the triangle disposed in juxtaposition with the viewing surface 18. The single crystal could be formed from a single Sapphire of natural origin. However, the present inventor has appreciated that a single crystal of material forming the solid block could be formed from a single crystal of laboratory-grown sapphire ($Al_2O_3$). Advantageously, such a single crystal of grown Sapphire demonstrates exceptional hardness and durability. Furthermore, as a single crystal, the anterior block of material forming the scope surface 22 and the putter face 116 is perfectly uniform in performance. Just as advantageously, the single crystal can be cut or formed with a substantially perfectly flat putter face 16. The grown sapphire crystal can be crafted to have substantially perfectly consistent optical properties. With this, the putter face 116 can be employed to strike golf balls in an entirely consistent and accurate manner.

In each embodiment, the material forming the lower wall 26 could be chosen from a variety of materials within the scope of the present invention. For example, it could be formed from any one of a variety of metals including brass or an aluminum, steel, or other metal alloy. In certain embodiments, it may be necessary or desirable to form the lower wall 26 also from a single crystal of grown Sapphire, which could be integral with or formed separately from the anterior block 22.

Under the construction of FIGS. 6 through 8, the golfer using the alignment system 10 can be provided with a true line of sight 20 with multi-point visual alignment of the orientation of the putter face 116 in relation to a target line and a golf ball 200. The golfer can then align and, ideally, strike putts along the desired target line. As can be perceived, for instance, by further reference to FIG. 7, a golfer looking directly down onto the golf putter head 112 and the alignment system 10 will readily be able to perceive and confirm the multi-point alignment of the crosshair scope 25, including the orthogonally-disposed crosshairs 24, the putter head 112, including with the sight line or lines 118 thereof, the golf ball 200, and the actual orientation of the putter head 112 in relation to the desired target line from the remote vantage point provided by the viewing surface 18. The alignment system 10 provides the golfer with the added advantage of an integral alignment mechanism 10 within the putter head 112 itself and directly within the golfer's viewing area. The golfer is thus able to view the alignment of the putter head 112 and the intended target line simultaneously. As a result, the golfer is also better able to align his or her body relative to the intended target line to ensure a proper putting stroke and to confirm proper putter orientation during setup and through the putting stroke without a need for adjustments or attachments. Golf putters 100 incorporating the alignment system 10 can be manufactured and used in compliance with the Rules of Golf.

From the foregoing, it will be clear that the present invention for a golf putter alignment system has been shown and described with reference to certain preferred embodiments. These, however, merely exemplify the broader invention revealed herein. Certainly, those skilled in the art can conceive of alternative embodiments. For instance, those with the major features of the invention in mind could craft embodiments that incorporate those major features while not incorporating all of the features included in the preferred embodiments.

With this in mind, the following claims shall define the scope of protection to be afforded to the inventor, and those claims shall be deemed to include equivalent constructions insofar as they do not depart from the spirit and scope of the present invention. A plurality of those claims may express or be interpreted to express certain elements as a means for performing a specific function, at times without the recital of structure or material. As the law demands, any such claims shall be construed to cover not only the corresponding structure and material expressly described in the specification but also equivalents thereof.

I claim as deserving the protection of Letters Patent:

1. A golf putter alignment system for providing a golfer with a view of an orientation of a putter face of a putter head of a golf putter relative to a putting line, the golf putter alignment system comprising:

a housing with a mirrored viewing surface for being retained in a plane at a viewing angle in relation to a plane of the putter face;

a mounting system for selectively retaining the housing and the mirrored viewing surface relative to the golf putter wherein the mounting system comprises an adjustable mounting system that is adjustable to permit an adjustment of a disposition of the viewing surface in relation to the plane of the putter face;

wherein the adjustable mounting system comprises an engaging portion, a pivot joint that permits adjustment of an angular orientation of the viewing surface relative to the putter face, and a sliding joint that permits adjustment of a lateral position of the viewing surface relative to the putter face;

wherein the engaging portion comprises a clip portion configured to engage a putter shaft of a golf putter in a snap-fit engagement for selectively attaching to the golf putter;

wherein the pivot joint comprises a sleeve joint comprising a core member that projects from one of the clip portion and the housing and an outer sleeve retained by the other of the clip portion and the housing and wherein the outer sleeve is pivotable about a longitudinal axis of the outer sleeve in relation to the core member whereby the housing can be pivoted in relation to the clip portion by a relative pivoting of the core member and the outer sleeve; and wherein the sliding joint comprises an elongate member wherein the housing and the viewing surface are slidable in relation to the elongate member.

2. The golf putter alignment system of claim 1 wherein the core member has resilient formations therealong to permit a pivotable but frictional engagement of the outer sleeve relative to the core member.

3. The golf putter alignment system of claim 1 wherein the outer sleeve is fixed to pivot with the viewing surface.

4. The golf putter alignment system of claim 1 wherein the elongate member has a non-round cross-section.

5. The golf putter alignment system of claim 4 wherein the elongate member has plural longitudinal ridges that communicate longitudinally along the elongate member.

6. The golf putter alignment system of claim 1 wherein the housing has a peripheral wall and a lower wall, wherein the peripheral wall and the lower wall cooperate to define an inner volume, wherein the housing has an open top and an open anterior portion, and wherein the viewing surface is disposed on the lower wall of the housing.

7. The golf putter alignment system of claim 6 further comprising a scope surface retained in spaced relation to the mirrored viewing surface.

8. The golf putter alignment system of claim 7 wherein the scope surface is transparent.

9. The golf putter alignment system of claim 8 further comprising an alignment scope disposed on the scope surface.

10. The golf putter alignment system of claim 1 wherein the core member projects from the clip portion and wherein the outer sleeve is retained by the housing.

* * * * *